US007896542B2

(12) United States Patent
Born et al.

(10) Patent No.: US 7,896,542 B2
(45) Date of Patent: Mar. 1, 2011

(54) TIMEPIECE MOVEMENT FITTED WITH A VIBRATING ALARM

(75) Inventors: Jean-Jacques Born, Morges (CH); Cédric Nicolas, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 12/628,529

(22) Filed: Dec. 1, 2009

(65) Prior Publication Data

US 2010/0135126 A1 Jun. 3, 2010

(30) Foreign Application Priority Data

Dec. 1, 2008 (EP) ..... 08020803

(51) Int. Cl.
*G04B 5/08* (2006.01)

(52) U.S. Cl. ..... 368/148; 368/208; 368/230; 368/244

(58) Field of Classification Search ..... 368/72, 368/74, 147–148, 207–208, 230, 244, 259–260
See application file for complete search history.

(56) References Cited

U.S. PATENT DOCUMENTS

| | | | | |
|---|---|---|---|---|
| 2,305,666 | A * | 12/1942 | Bolsey | 74/126 |
| 2,667,737 | A * | 2/1954 | Gazda | 368/148 |
| 2,739,682 | A * | 3/1956 | Detwiler | 192/46 |
| 2,756,559 | A * | 7/1956 | Derr | 368/148 |
| 2,874,532 | A * | 2/1959 | Baier | 368/148 |
| 5,023,853 | A * | 6/1991 | Kawata et al. | 368/230 |
| 5,878,004 | A * | 3/1999 | Miyauchi et al. | 368/230 |
| 6,349,075 | B1 | 2/2002 | Miyauchi et al. | |
| 2010/0135127 | A1 * | 6/2010 | Born et al. | 368/127 |

FOREIGN PATENT DOCUMENTS

| | | |
|---|---|---|
| CH | 330 203 | 5/1958 |
| CH | 343 928 | 12/1959 |
| EP | 0 547 250 | 6/1993 |
| EP | 1 980 922 | 10/2008 |
| FR | 2 196 490 | 3/1974 |

OTHER PUBLICATIONS

Article concerning a wristwatch marketed by Jaeger Lecoultre as "Master Grand Réveil," published 2006.
European Search Report issued in corresponding application No. 08 02 0803, completed May 27, 2009.

* cited by examiner

*Primary Examiner* — Vit W Miska
*Assistant Examiner* — Sean Kayes
(74) *Attorney, Agent, or Firm* — Griffin & Szipl. P.C.

(57) ABSTRACT

The invention concerns a timepiece movement that includes first and second energy sources, wherein the first energy source is coupled to an oscillating weight by a first kinematic chain for automatically winding the movement, and the second energy source is coupled both to an activating device, and to a vibrating element by a second kinematic chain, to form a vibrating alarm mechanism that can be activated at a predetermined time. In addition, for the timepiece movement, the vibrating element of the vibrating alarm mechanism is the oscillating weight.

14 Claims, 4 Drawing Sheets

TIMEPIECE MOVEMENT FITTED WITH A VIBRATING ALARM

This application claims priority from European Patent Application No. 08020803.6 filed Dec. 1, 2008, the entire disclosure of which is incorporated herein by reference.

FIELD OF THE INVENTION

The invention concerns timepiece movements that include alert or alarm mechanisms, and, in particular, movements of this type, which are automatically wound and have vibrating alarms, and which are intended for wristwatches, pocket watches or suchlike.

BACKGROUND OF THE INVENTION

A wristwatch marketed by Jaeger Lecoultre under the reference "Master Grand Réveil" includes an alarm mechanism that automatically activates an alarm at a time predefined by the user. This alarm function is performed by a mechanism connected to the movement, which includes an independent barrel, a setting system for programming the strike time, an triggering system connected to the going train of the movement that activates the alarm at the set time, and a strike mechanism for alerting the user. The strike mechanism includes a gong, which is struck by a hammer to generate an acoustic signal, and also means for making the watch vibrate without generating an audible acoustic signal. A switch is used to select whether the acoustic alarm or silent vibrating alarm is activated.

This watch has drawbacks however. Indeed, the alarm mechanism includes specific elements enabling the mechanism to operate in silent alarm mode, which increases the complexity and size of the structure. Moreover, the vibration amplitude is limited.

SUMMARY OF THE INVENTION

It is an object of the present invention to overcome one or more of these drawbacks of the aforementioned prior art, by providing an automatically wound timepiece movement that includes a silent vibrating alarm mechanism advantageously using elements of the movement and generating a large amplitude vibration.

It is also an object of the invention to provide a timepiece movement that includes an alarm device of this type, the design of which is particularly simple and inexpensive to implement.

The invention therefore concerns a timepiece movement that includes first and second energy sources, wherein the first energy source is coupled to an oscillating weight by a first kinematic chain for automatically winding said movement, and the second energy source is coupled both to an activating device and to a vibrating element by a second kinematic chain to form a vibrating alarm mechanism that can be activated or triggered at a predetermined time. The timepiece movement is characterized in that the vibrating element of the vibrating alarm mechanism is the oscillating weight.

The vibrating alarm mechanism obtained has the advantage of being simplified, since the natural unbalance of the oscillating weight of the automatic winding mechanism is also used to generate the alarm vibration. Consequently, space is saved for housing other modules in the watchcase, such as, for example, a chronograph module, without requiring any increase in the watch calibre. Moreover, the use of the oscillating weight as the vibrating element provides vibrations of larger amplitude than with a conventional vibrating element, and, at the same time, also decreases the number of parts to be assembled. This leads to easier assembly and a decrease in manufacturing costs for a watch that includes this type of movement.

BRIEF DESCRIPTION OF THE DRAWINGS

Other features and advantages of the invention will appear clearly from the following description, made with reference to the annexed drawings, in which.

DETAILED DESCRIPTION OF THE PREFERRED EMBODIMENTS

Figure 1:
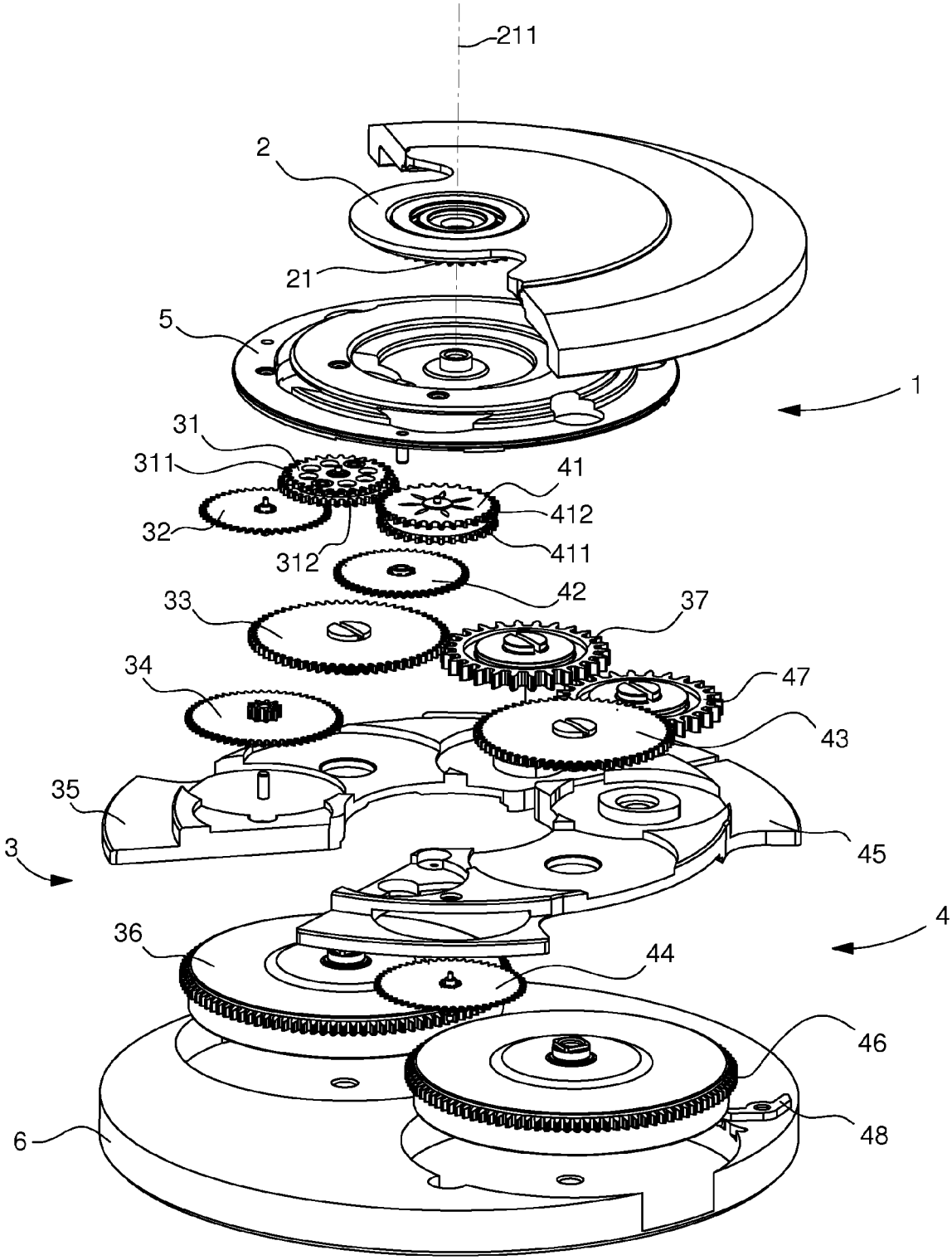
FIG. 1 is an exploded perspective view of one part of the movement forming a vibrating alarm according to a preferred embodiment of the invention.

FIG. 1 shows an exploded perspective view of a timepiece movement 1 for a wristwatch according to a preferred variant of the invention. The timepiece movement 1 proposed associates a vibrating alarm mechanism with a timepiece movement that includes an automatic winding mechanism, known to those skilled in the art. This automatic winding mechanism of movement 1 uses the rotation of an oscillating weight 2 to store mechanical energy in a barrel 36 via a gear train 31, 32, 34 forming a kinematic chain 3, which meshes on weight pinion 21 of oscillating weight 2, which forms a toothed wheel. Because of the shift in the centre of gravity of oscillating weight 2 relative to its axis of rotation 211, which is also that of weight pinion 21, the user's wrist movements cause this oscillating weight 2 to rotate relative to the watchcase. The rotation of oscillating weight 2 causes ratchet wheel 33 of barrel 36 to rotate at the end of the kinematic chain. The rotation of ratchet wheel 33 winds the spring inside barrel 36 and thus stores mechanical energy, which will be distributed towards a going train (not shown) that meshes on the teeth of barrel 36. According to the preferred embodiment illustrated in FIG. 1, this winding mechanism is of the type that only winds in one direction, owing to reverser wheel 31, the working of which will be explained below with particular reference to FIG. 3. Wheel sets 32 and 34 are reduction wheel sets that each include a coaxial, joined wheel and pinion and their purpose is to establish a suitable gear ratio for adjusting the rotational velocity to be obtained at the end of gear train 3 as a function of the velocity of weight pinion 21.

As shown in FIG. 1, oscillating weight 2 is rotatably mounted on a support 5 secured to a bottom plate 6, which is secured in the watchcase. The reverser wheel 31 is also rotatably mounted on support 5, which has suitable cut-out portions so that weight pinion 21 of oscillating weight 2 meshes with a first toothing 311 of reverser wheel 31, whereas a second toothing 312 of reverser wheel 31 meshes with the wheel of reduction wheel set 32. Reverser wheel 31 forms a "free wheel": in the first direction of rotation of oscillating weight 2, the first toothing of the first wheel set 311 of reverser wheel 31 is coupled to the second toothing of the second wheel set 312 of the reverser wheel, whereas in the second direction of rotation of oscillating weight 2, the first toothing 311 of reverser wheel set 31 is uncoupled from second toothing 312. The reduction wheel set 32 is rotatably mounted relative to support 5, and the pinion of reduction wheel set 32 meshes with a wheel of another reduction wheel set 34, rotatably mounted on a bridge 35, which is secured to bottom plate 6.

As illustrated in FIG. 1, barrel 36 includes a ratchet wheel 33 rotatably mounted relative to bridge 35, but secured in rotation relative to the hub of barrel 36, which meshes with the pinion of reduction wheel set 34 to automatically wind the movement. However, it is also possible to wind the barrel manually via winding wheel 37, which also meshes with ratchet wheel 33. Winding wheel 37 is rotatably mounted relative to bridge 35 and can be set in rotation by the user who wishes to wind the watch manually by activating a stem or crown that has an external knob (not shown). The energy stored in the spring (not illustrated) of barrel 36 can consequently be obtained either by rotating oscillating weight 2, or by manual winding.

Movement 1 also includes a vibrating alarm mechanism 4, which includes an energy source 46, an activation device 48, a kinematic chain 4 and a vibrating element 2. According to the embodiment illustrated in FIG. 1, the energy source used for the vibrating alarm mechanism is a second barrel 46, independent of the first barrel 36 used for the going train. However, another energy source could be envisaged, for example an electric or electromechanical source, for powering the vibrating alarm device of the invention, and/or the normal time display. It is, for example, possible to apply the invention to an ETA Autoquartz type mechanism, in which the mechanical energy from the oscillating weight is used for powering a generator, coupled to an accumulator, which supplies electrical energy to a quartz motor. According to the invention, the activation device is a click 48, which locks barrel 46 in rotation outside the alarm times, but releases it exactly when the alarm is activated or triggered at a determined time, which can preferably be set by the user. When alarm 4 is activated at a determined time, click 48 pivots, leaving the toothing of barrel 46 free to rotate. A control device (not shown) pivots click 48 between a locking position, outside the alarm time, and a release position during the alarm time.

The vibrating element of the vibrating alarm mechanism is oscillating weight 2, which is driven in rotation at the end of a kinematic chain 4, driven by the rotation of barrel 46, and which preferably includes an activation mechanism 41, described below with reference to FIGS. 4 to 6. The vibrating alarm mechanism is for generating a detectable vibration on the user's wrist; when the watch rests on a hard surface, the vibrations generated by the alarm mechanism will make the watch jump, which makes a noise upon impact with the surface, According to a preferred variant of the invention, the vibrating alarm mechanism includes a first reduction wheel set 44, formed of a pinion and a wheel, secured to each other in rotation, similar to reduction wheel sets 32, 34 of kinematic chain 3 associated with the automatic winding device of the movement. However, unlike wheel set 34 illustrated in FIG. 1, the pinion of reduction wheel set 44 is located underneath the wheel of the same wheel set and meshes directly with the toothing of barrel 46. Reduction wheel set 44 is rotatably mounted on a bridge 45, secured to bottom plate 6; its wheel meshes with the pinion of a second reduction wheel set 42, which is also rotatably mounted on bridge 45. The wheel of reduction wheel set 42 is coupled to a coupling device 41, which includes first and second activation wheel sets 411, 412, arranged such that the rotation of the first wheel set causes the second wheel set 412 to rotate. The teeth of the wheel of reduction wheel set 42 mesh on the teeth of the first reduction wheel set 411, whereas the teeth of the second reduction wheel set 412 mesh on weight pinion 21 of oscillating weight 2.

According to the preferred embodiment of the invention, the energy stored in barrel 46 and released when the alarm mechanism is activated, is obtained via a manual winding mechanism. Indeed, a winding wheel 47 is shown, side-by-side with the winding wheel 37 of barrel 36. This winding wheel 47 meshes with ratchet wheel 43 of barrel 46, and can thus wind the spring inside the barrel. Ratchet wheels 43 and winding wheel 47 are rotatably mounted relative to bridge 45. Winding wheel 47 can be set in rotation by the user who wishes to wind the watch manually by activating a stem or crown fitted with an external knob (not illustrated, similar to the manual winding mechanism associated with wheel 37).

When the alarm is activated, click 48 releases the energy stored in the spring of barrel 46 and sets the peripheral teeth of barrel 46 in rotation. According to a preferred embodiment, the maximum energy stored in barrel 46 and the gear ratios of the gear train for kinematic chain 4, which drives first activation wheel set 411, are determined such that oscillating weight 2, which acts as vibrating element, rotates for approximately 15 seconds after the alarm has been activated. Moreover, the gear ratios of reduction wheel sets 42, 44 for determining the rotational velocity ratio between barrel 46 and the oscillating weight, are calculated to be approximately five times smaller than those used in the first automatic winding kinematic chain 3 of movement 1, where the velocity ratio between the barrel supplying the power reserve 36 and the oscillating weight is calculated. These ratios and the energy that can be stored will depend in particular upon the desired alarm vibration time, which could preferably be set between 10 and 20 seconds. According to a preferred embodiment, the vibration time could be adjusted by the user, acting on winding wheel 47, by consulting a visual gauge coupled to barrel 46, which determines the level of energy stored in the barrel.

Figure 2:
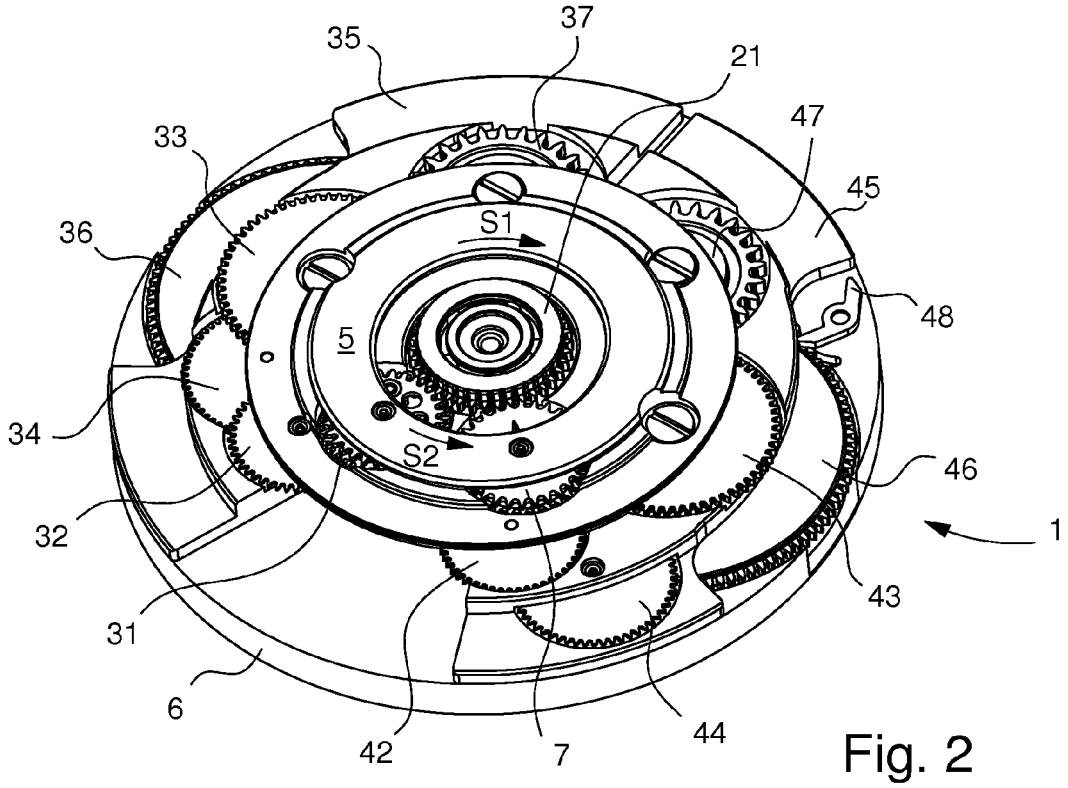
FIG. 2 is a perspective view of the movement of FIG. 1 once assembled.

FIG. 2 shows movement 1 according to the preferred embodiment of FIG. 1 when all of the parts have been assembled on bottom plate 6. Only oscillating weight 2 is not visible in order to show all of the parts that it covers once it is secured to weight pinion 21. Thus, only support 5 of oscillating weight 2 can be seen. As illustrated in FIG. 2, it can be seen that weight pinion 21 meshes both with reverser wheel 31 and coupling device 41, and more specifically first wheel set 311 of the reverser wheel and second wheel set 412 of coupling device 41. The fact that these two wheel sets 311 and 412 mesh directly with the weight pinion means that they always rotate in the same direction, which is opposite to the direction of rotation of oscillating weight 2. However, wheel set 311 is a driving wheel set, which causes the movement to be automatically wound when the oscillating weight rotates in a given direction of rotation S1, whereas wheel set 412 is a driven wheel set, which is activated in rotation when the energy from barrel 46 is released, but it never causes the second wheel 411 of the coupling mechanism to rotate. According to this embodiment, the direction of rotation S1 of the oscillating weight for automatically winding movement 1 is chosen to be the opposite of direction of rotation S2 of oscillating weight 2 when the alarm is activated or triggered. The fact that, via second kinematic chain 4, the mechanical energy from barrel 46 causes said oscillating weight 2 to rotate in the opposite direction to the direction that winds first barrel 36 via reverser wheel 31, allows the couple required for driving the oscillating weight pinion 21 to be minimized when the alarm is activated, and consequently, for a given amount of energy stored in the barrel, provides a longer vibration period. However, according to an alternative embodiment, one could envisage that activating the alarm mechanism would also allow movement 1 to be automatically wound at the same time. In this case, the energy—or at least part of the energy—stored in barrel 46 would then be transferred into barrel 36 each time the alarm was activated. However, this variant would involve wasting energy and a large torque is necessary to ensure that oscillating weight 2 can be set in rotation even when the spring of barrel 46 is completely wound.

In FIG. 2, the elements numbered 31, 32, 34 form the automatic winding kinematic chain of movement 1, for storing mechanical energy in barrel 36. For a given direction of rotation S1, the first wheel set 311 of the reverser wheel drives the second wheel set 312 in rotation, which in turn drives the wheel of a first reduction wheel set 32, mounted on a bridge 35. The pinion of the first reduction wheel set 32, located underneath the wheel of the same wheel set 32, drives the wheel of the second reduction wheel set 34, which is rotatably mounted on the same bridge. The pinion of this second reduction wheel set 34, drives ratchet wheel 33 of the barrel. As indicated in the above description, ratchet wheel 33 of barrel 36 also meshes on the teeth of winding wheel 37, for manually winding movement 1. The second kinematic chain 44, 42, 41 converts the energy from barrel 46 into a rotation of oscillating weight 2. We start this time from barrel 46, which, once set in rotation as soon as click 48 is released from one of the teeth of the toothing, meshes with the pinion of reduction wheel set 44, located underneath the wheel of the same wheel set, visible in FIGS. 2 and 3, and which is rotatably mounted on bridge 45. The wheel of the same wheel set 44 meshes with the pinion of second reduction wheel set 42, also rotatably mounted on bridge 45. The wheel of this same wheel set meshes with the inertial click wheel 41, which forms the coupling mechanism and which will be described in detail with reference to the Figures below. The wheel of reduction wheel set 42 meshes more specifically on a pinion 417, illustrated below in FIG. 4, secured to the first wheel set 411 of coupling mechanism 41, which drives second wheel set 412 in rotation, forming the end of this kinematic chain. The second coupling mechanism wheel set 412 meshes, finally, with weight pinion 21 so as to rotate oscillating weight 2.

Unlike the automatic winding mechanism of movement 1 using kinematic chain 3, kinematic chain 4 thus releases the energy from barrel 46 rather than storing it inside. Thus, unlike the gear train associated with barrel 36, the alarm mechanism gear train does not have an automatic winding mechanism, but only a manual winding mechanism. Winding wheel 47, which meshes on ratchet wheel 43 of barrel 46, is used to achieve this, for example by activating an external knob, as explained in the above description. Although no automatic winding mechanism is provided in accordance with the preferred embodiment illustrated, it would, however, be possible to add one, for example via an additional gear train. This would however have the drawback of requiring more space in the case.

Figure 3:
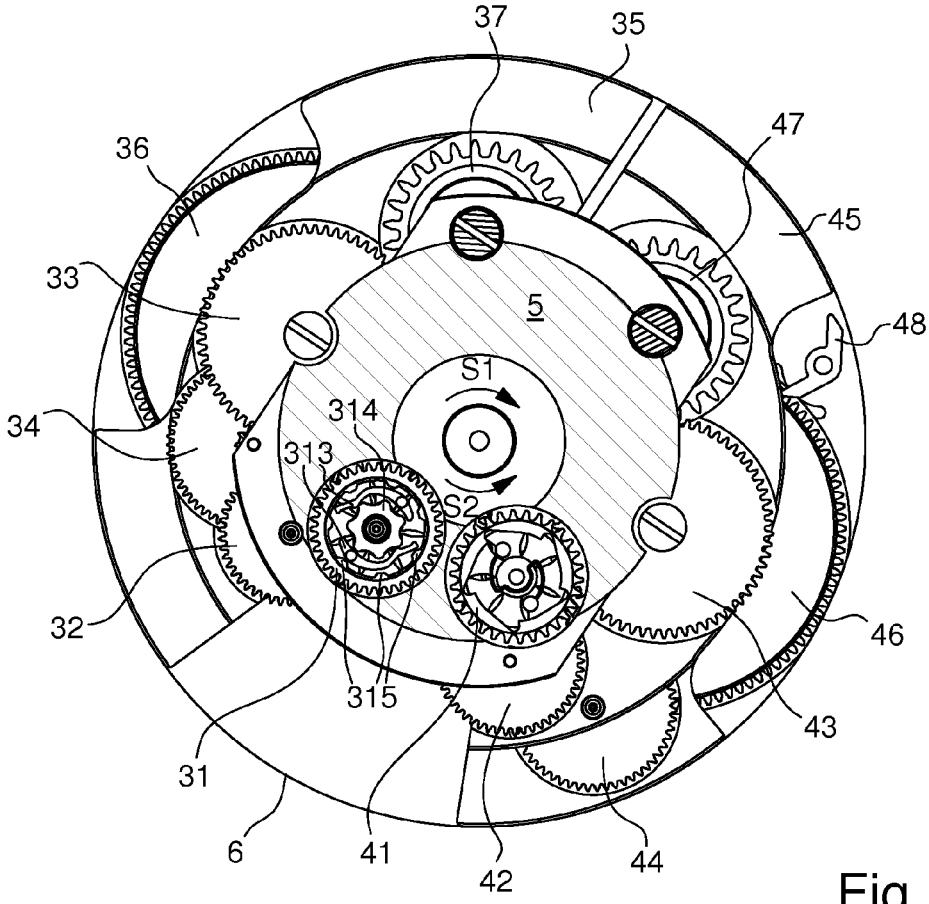
FIG. 3 is a top view of the movement of FIG. 1 in cross-section along the support for the oscillating weight.

FIG. 3 illustrates the movement of FIG. 2 in cross-section along oscillating weight support 5, to show the operation of coupling mechanism 41 and the inside of reverser wheel 31 more clearly. All of the other constituent elements of the movement are identical to those illustrated in FIG. 2. As indicated previously, reverser wheel 31 meshes with weight pinion 21 of oscillating weight 2, but only activates the winding mechanism of movement 1 in one given direction of rotation of weight pinion 21, illustrated by the direction S1 in the Figure. The reverser wheel includes a first driving wheel set 311 and a wheel set 312, which is driven by a free wheel type click system. Studs, on which clicks 313 are mounted, are secured to first wheel set 311, whereas stop members 315 are formed at the periphery of second wheel set 312, which is also secured to a star-shaped hub 314 on its axis of rotation. The arms of click 313 cooperate with hub 314 and stop members 315 such that they drive the second wheel set in rotation in rotational direction S1, and are unclicked in the opposite direction S2.

The coupling mechanism 41 used in the preferred embodiment illustrated in this Figure consists of an inertial click wheel, of which the following elements can be seen in cross-section (NB: the references below are given with reference to FIG. 4, which is an enlargement of FIG. 3): a hub 415, at the centre, associated with the first coupling wheel set 411, to which flexible strips 414 are secured, with inertia-blocks 413 mounted on the end of said strips. When the first coupling wheel set 411 is driven in rotation by the action of reduction wheel set 42 on pinion 417, inertia-blocks 413 are drawn radially outwards. The flexibility of strips 414 enables these inertia-blocks 413 to move radially outwards; they are then meshed with stop members 416 secured to the second coupling wheel set, which is then driven in rotation. For the sake of legibility, the above references of the constituent elements of the inertial click wheel have not been added to FIG. 3, but only to the enlargement of that cross-sectional view shown in FIG. 4. FIGS. 5 and 6, explained below, also describe in detail different views of this coupling mechanism 41.

Although in the illustrated preferred embodiment, the two elements 31 and 41 mesh directly with the weight pinion and therefore have the same direction of rotation, one could also place an intermediate gear train between one of these elements and weight pinion 21 to reverse the direction of rotation of the elements relative to each other if necessary. One could also envisage a gear train that can automatically wind movement 1 in both directions of rotation of the oscillating weight, for example by meshing an additional wheel both on weight pinion 21 and on another reverser wheel 31' (not shown), similar to reverser wheel 31, such that whatever the direction of rotation S1 or S2 of the weight pinion, one of the two reverser wheels 31 or 31' always automatically winds the movement. If wheel 31 is the driving wheel, the direction of reverser wheel 31' will cause the driven wheel set to be unclicked, and vice versa, since reverser wheels 31 and 31' would then always be driven in opposite directions. However, this embodiment has the same drawbacks as the one wherein the direction in which the alarm mechanism drives oscillating weight 2 is the same as the direction in which barrel 36 of the movement is automatically wound, namely that energy will be wasted in driving the vibrator, on the one hand, and on the other hand, the torque to be released by barrel 46 must be very large to ensure that the alarm is activated whatever the state of tension of the spring inside barrel 36.

The description below concerns FIGS. 4 to 6, which show in more detail the operation of the inertial click wheel 41. FIG. 4 is an enlargement of FIG. 3 that focuses on coupling mechanism 41, formed by the illustrated inertial click wheel. More specifically, the Figure shows hub 415 at the centre, strips 414, inertia-blocks 413, which are secured to first wheel set 411, and stop members 416, secured to second wheel set 412, of which the external teeth, which will mesh on weight pinion 21, are shown. As will be seen below with reference to FIG. 6, stop members 416 and the teeth of the second coupling wheel set 412 are not located in the same plane. FIG. 5 shows this wheel set 412 specifically, in a top view, and the outer teeth thereof. Inertia-blocks 413 and flexible strips 414 can be seen through the hollows of wheel set 412. The coupling mechanism 41 thereby formed is a centrifugal coupling mechanism, including an inertial click formed by strips 414 and inertia-blocks 413, secured to hub 415 of the first coupling wheel set 411. Gearing only occurs with stop members 416, secured to second coupling wheel set 412, when strips 414 are sufficiently extended under the effect of the radial acceleration of inertia-blocks 413, which is determined by the rotational velocity of hub 415, which is also that of first wheel set 411. This velocity must be higher than a minimum threshold to ensure that strips 414 extend sufficiently to press the inertia-blocks against stop members 416. It could be adjusted by calculating, advisedly, amongst other things, the gear ratios of kinematic chain 4, and particularly those of reduction wheel sets 42, 44.

Figure 4:
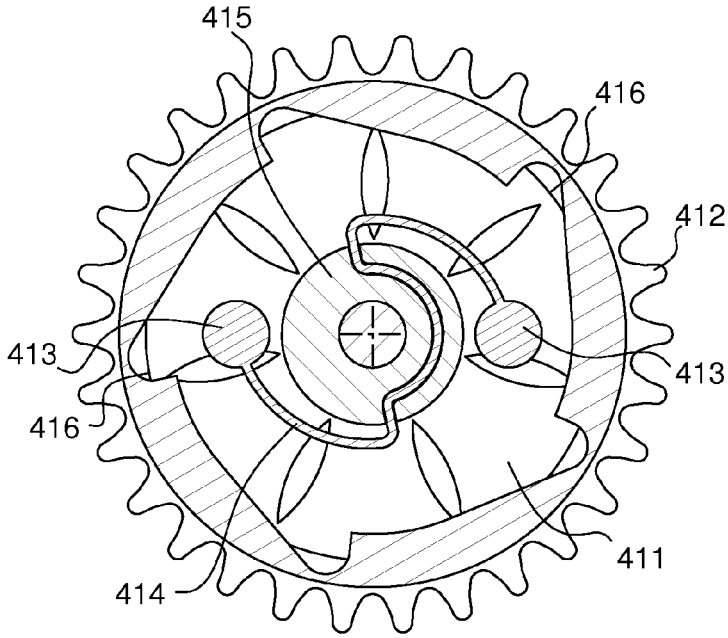
FIG. 4 is an enlargement of the cross-section of the coupling device seen in FIG. 3.

As can be seen in FIG. 4, stop members 416 are arranged in inertial click wheel 41, such that the first coupling wheel set 411 only drives the second coupling wheel set 412 in rotation in one given direction of rotation of first coupling wheel set 411, which is defined by the direction of rotation of barrel 46 when the spring is let down. The notches are oriented such that meshing is optimal when first wheel set 411 is rotating in the anti-clockwise direction. One could, however, imagine, in an alternative implementation, the stop members being arranged such that they allow second wheel set 412 to mesh and be coupled in rotation in any rotational direction of first wheel set 411, so that maximum flexibility is ensured for the assembly of the coupling mechanism and adaptation thereof to all existing types of movements 1, particularly in terms of bottom plates 6, barrel toothings 46 and the orientation of clicks 48.

Figure 5:
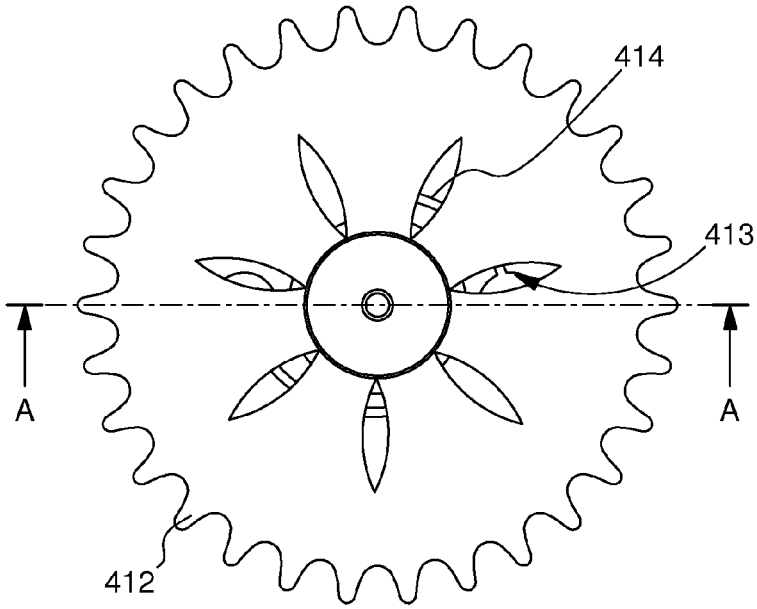
FIG. 5 is a top view of the coupling device of FIG. 4.
Figure 6:
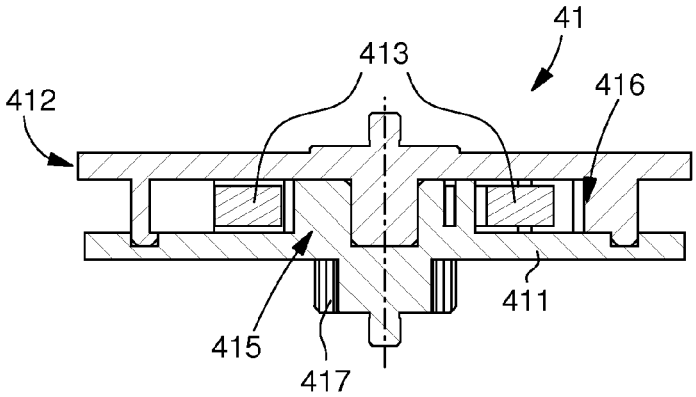
FIG. 6 is a sagittal cross-section of the coupling device of FIGS. 4 and 5.

FIG. 6 illustrates a cross-section along plane A-A visible in FIG. 5 of inertial click wheel 41. One can see pinion 417, underneath first coupling wheel set 411, and hub 415 and inertia-blocks 413 secured to first wheel set 411. On the top, forming a sort of cover on first wheel set 411, one can see second wheel set 412 and stop members 416 on the lateral external walls of inertial click wheel 41. This Figure clearly shows the relative driving-driven character of wheel sets 411 and 412 in relation to each other: the rotation of first coupling wheel set 411 causes the second coupling wheel set 412 to rotate, but rotation of the second coupling wheel set never causes the first coupling wheel set 411 to rotate. Consequently, when oscillating weight 2 moves, when the alarm mechanism is not being activated, the rotation of weight pinion 21 only causes second coupling wheel set 412 to rotate, and never has any influence on the rest of kinematic chain 4.

It should be noted that, according to the preferred embodiment of the invention illustrated by FIGS. 1 to 6, the rotation of oscillating weight 2 in direction S2 indicated in the Figures never causes movement 1 to wind automatically—involving kinematic chain 3—because of the presence of reverser wheel 31, and this is true regardless of whether oscillating weight 2 is being driven, when the alarm is being activated, or driving, outside the alarm times, when it can rotate freely. During use of the watch outside the alarm times, the rotation of oscillating weight 2 has no influence on the alarm mechanism gear train apart from second coupling wheel set 412, whatever the direction of rotation, i.e. S1 or S2. A driving action of oscillating weight 2 back on barrel 46 may be provided, as already indicated in the above description, for example in order to wind the alarm mechanism automatically. However, this backwards driving action would, in theory, require adding extra wheel sets.

The invention can thus cause a watchcase to vibrate, when the latter contains the vibrating alarm mechanism according to the invention, and which uses oscillating weight 2 of the automatic winding mechanism of movement 1. The vibration produced by the rotation of oscillating weight 2 could be amplified by an additional vibrating element. This additional vibrating element could, for example, be connected to the case and arranged on the travel of oscillating weight 2 so that it is struck by oscillating weight 2 when it is driven by second coupling wheel set 412, i.e. when the alarm is being activated. The position of this additional vibrating element will, however, preferably be determined such there is no interaction with oscillating weight 2 when the alarm mechanism is not being activated, to avoid interference in the winding of barrel 36 by oscillating weight 2.

Figure 7:
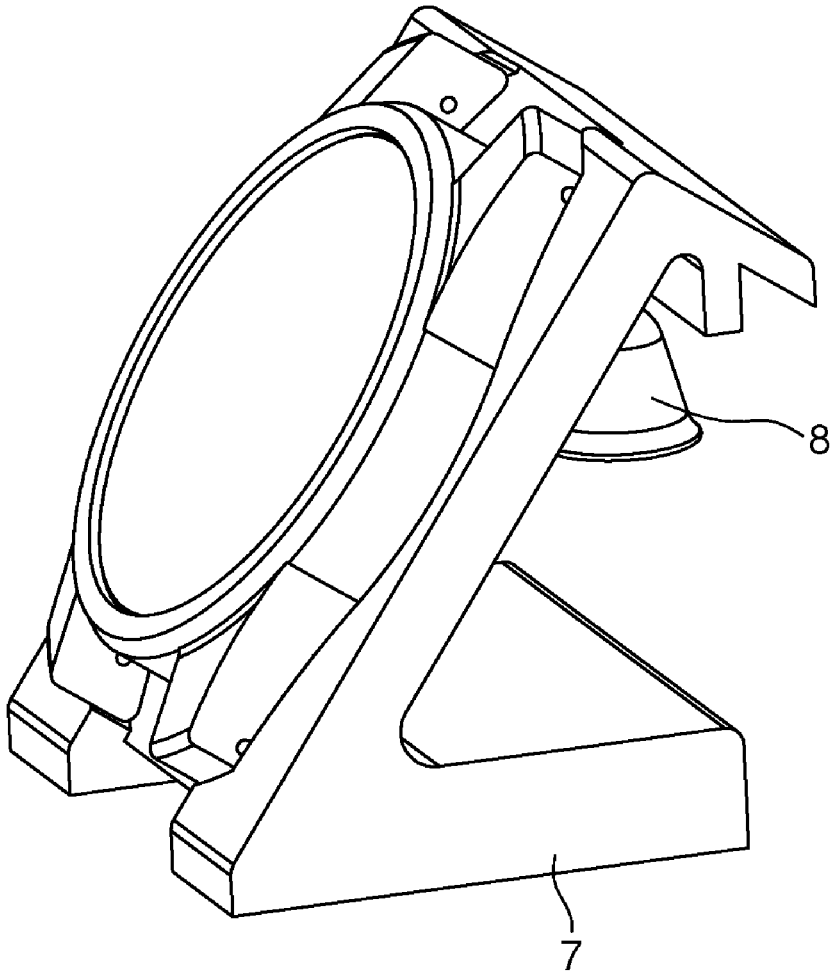
FIG. 7 is a view of a support, provided with an element that generates an acoustic signal, for receiving a watch fitted with the alarm mechanism of the invention.

The watch including a vibrating alarm mechanism according to the invention could also be associated with a timepiece device including a support 7, illustrated by FIG. 7, adapted to receive the watch. Support 7 could include an element that generates an acoustic signal 8, such as, for example, a bell according to the variant illustrated, or even a gong, configured to emit a sound when the watch is placed on support 7 and the vibrating alarm mechanism is activated. Thus, the user could choose between a silent mode when the watch is used without its support and an acoustic mode when the watch is used on its support 7, to improve operational use and comfort.

LIST OF REFERENCES

| | |
|---|---|
| 1 | Movement |
| 2 | Oscillating weight |
| 21 | Weight pinion |
| 211 | Axis of rotation of the weight pinion |
| 3 | Kinematic chain for automatic winding |
| 31 | Reverser wheel |
| 311 | First wheel set of the reverser wheel |
| 312 | Second wheel set of the reverser wheel |
| 313 | Clicks secured to the first wheel set of the reverser wheel |
| 314 | Hub of the second wheel set of the reverser wheel |
| 315 | Peripheral stop members of the second reverser wheel |
| 32 | Reduction wheel set |
| 33 | Ratchet wheel of barrel 36 |
| 34 | Wheel of another reduction wheel set |
| 35 | First bridge secured to the bottom plate |
| 36 | Barrel of the automatic movement |
| 37 | Winding wheel for barrel 36 |
| 4 | Kinematic chain for the vibrating alarm mechanism |
| 41 | Coupling mechanism |
| 411 | First coupling wheel set |
| 412 | Second coupling wheel set |
| 413 | Inertia-blocks |
| 414 | Flexible strips |
| 415 | Hub of the first coupling wheel set |
| 416 | Stop members |
| 417 | Pinion secured to the first coupling wheel set |
| 42 | $1^{st}$ reduction wheel set |
| 43 | Ratchet wheel of the alarm barrel |
| 44 | $2^{nd}$ reduction wheel set |
| 45 | Second bridge secured to the bottom plate |
| 46 | Barrel for the vibrating alarm mechanism |
| 47 | Winding wheel for barrel 46 |
| 48 | Retaining click for the barrel toothing |
| 5 | Support for the oscillating weight |
| 6 | Bottom plate |
| 7 | Watch support |
| 8 | Element generating an acoustic signal |

What is claimed is:

1. A timepiece movement including:

(a) a first energy source, wherein said first energy source is coupled to an oscillating weight by a first kinematic chain for automatically winding said movement; and (b) a second energy source, wherein said second energy source is coupled both to an activating device, and to a vibrating element, by a second kinematic chain, to form a vibrating alarm mechanism that can be activated or triggered at a predetermined time;

wherein the vibrating element of said vibrating alarm mechanism is said oscillating weight.

2. The timepiece movement according to claim 1, wherein said first energy source and said second energy source each comprise a barrel, and these two barrels are independent.

3. The timepiece movement according to claim 2, wherein the barrel of said vibrating alarm mechanism is locked in rotation by a click outside the alarm times, and released in rotation during activation of the alarm.

4. The timepiece movement according to claim 2, including a manual mechanism for winding each barrel.

5. The timepiece movement according to claim 1, wherein said second kinematic chain includes a coupling mechanism, wherein said coupling mechanism includes a first coupling wheel set and a second coupling wheel set, and rotation of said first coupling wheel set causes said second coupling wheel set to rotate.

6. The timepiece movement according to claim 5, wherein said coupling mechanism is a centrifugal coupling mechanism including an inertial click secured to a hub of said first coupling wheel set, and meshing with stop members secured to said second coupling wheel set.

7. The timepiece movement according to claim 6, wherein said first coupling wheel set only drives said second coupling wheel set in rotation in a single given direction of rotation.

8. The timepiece movement according to claim 7, wherein said second coupling wheel set meshes with the weight pinion of said oscillating weight.

9. The timepiece movement according to claim 8, wherein said first kinematic chain includes a reverser wheel that meshes with said weight pinion of said oscillating weight, and said reverser wheel only activates the winding mechanism for said movement in a single given direction of rotation of said weight pinion.

10. The timepiece movement according to claim 9, wherein said second energy source and said second kinematic chain cause said oscillating weight to rotate in the opposite direction to that in which said first energy source is wound via said reverser wheel.

11. The timepiece movement according to claim 1, wherein said second kinematic chain includes at least one velocity reduction wheel set.

12. The timepiece movement according to claim 11, wherein the energy from said second energy source and the gear ratios of said second kinematic chain are determined so that said oscillating weight rotates for approximately 15 seconds after the alarm has been activated.

13. A watch including:

a case; and a timepiece movement according to claim 1 housed inside said case.

14. A horological device including:

a watch according to claim 13; and a support designed to receive said watch, wherein the support includes an element that generates an acoustic signal configured to emit a sound when the watch is placed in the support and said vibrating alarm mechanism is activated.

* * * * *